US006616129B1

(12) United States Patent
Lee

(10) Patent No.: US 6,616,129 B1
(45) Date of Patent: Sep. 9, 2003

(54) HOISTING DEVICE FOR SPREADER SUPPORTING SLIDE OF A SUNSHADE

(76) Inventor: Chorng-Cheng Lee, No. 272, Lane 365, Wu Feng South Road, Chia Yi (TW)

( * ) Notice: Subject to any disclaimer, the term of this patent is extended or adjusted under 35 U.S.C. 154(b) by 0 days.

(21) Appl. No.: 10/229,085

(22) Filed: Aug. 28, 2002

(51) Int. Cl.[7] ..... B66D 1/00

(52) U.S. Cl. ..... 254/266; 254/334; 135/20.3; 135/24

(58) Field of Search ..... 254/266, 334, 254/345, 346, 347, 356, 365, 366, 368, 378; 135/20.3, 24, 25.4

(56) References Cited

U.S. PATENT DOCUMENTS 3,817,494 A * 6/1974 Eckerdt ..... 254/330
4,622,987 A * 11/1986 Redl et al. ..... 135/20.3
4,674,522 A * 6/1987 Ma ..... 135/20.3
6,230,724 B1 * 5/2001 Lai ..... 135/20.3
6,435,444 B1 * 8/2002 Lin ..... 242/396.6

* cited by examiner

*Primary Examiner*—Emmanuel Marcelo
(74) *Attorney, Agent, or Firm*—Rosenberg, Klein & Lee

(57) ABSTRACT

A hoisting device for spreader supporting slide member of a sunshade includes first and second ratchet combinations each including a first ratchet, and a second turning ratchet. The ratchet combinations are positioned to face two opposite sides of the sunshade shank with the second ratchets being positioned between corresponding first ratchets and the shank. The ratchet combinations are biased towards the shank with springs. A shaft is passed through the shank plus the ratchet combinations, and is joined to a handle for effecting rotation thereof. The shaft is joined to a reel, which contacts the second ratchets at two end disk portions. Friction of the second ratchets against the end disk portions counteracts gravity on the slide member to prevent the sunshade from unwontedly folding from spread position once the sunshade is spread.

3 Claims, 4 Drawing Sheets

HOISTING DEVICE FOR SPREADER SUPPORTING SLIDE OF A SUNSHADE

BACKGROUND OF THE INVENTION

1. Field of the Invention

The present invention relates to a hoisting device for spreader supporting slide member of a sunshade, and more particularly to a hoisting device, which can be easily operated to lift and lower a sunshade spreader supporting slide member, and which can stop the supporting slide member from moving down due to gravity when the ring is lifted to higher position to spread the sunshade, thus preventing the sunshade from unwontedly folding from the spread in-use position.

2. Brief Description of the Prior Art

Sunshades are often fixed to stationary stands or centers of tables for use on beaches, outdoor cafes, etc. Conventional sunshades are usually very big so that they can provide shelter from direct light of the sun for several people. Such sunshades also have relatively long shanks therefore it is difficult for people having relatively short body length to raise the spreader supporting slide members of sunshades directly with their hands to spread the sunshades. To overcome this disadvantage, hoisting devices for the spreader supporting slide members are fitted to lower sections of shanks for people to readily operate the same to raise the spreader supporting slide members for spreading the sunshades. Conventional hoisting devices of sunshades usually consist of reels, pulley, handles, and hoisting ropes connected to the spreader supporting slide members so that users can operate the handle to wind the ropes around the reels to raise the spreader supporting slide members.

However, the spreader supporting slide members are likely to move down unexpectedly due to gravity after they are moved up to spread the sunshades because there is no fixing mechanism that can effectively fix the slide members in raised positions. Consequently, the sunshades are prone to fold unexpectedly, causing inconvenience and danger to the users.

SUMMARY OF THE INVENTION

It is a main object of the present invention to provide a hoisting device for a sunshade spreader supporting slide member so that the ring cannot move down to cause unexpected folding of the sunshade due to gravity once the sunshade is spread.

The hoisting device of the present invention includes first and second ratchet combinations each including a first ratchet, and a second ratchet capable of turning clockwise. The ratchet combinations are positioned to face two opposite outer sides of the sunshade shank with the second ratchets being positioned between corresponding first ratchets and the shank. The ratchet combinations are biased towards opposite holes on the sides of the shank with springs. A reel is passed through the holes of the shank, and the ratchet combinations. Two ends of the reel are each joined to a stopped disk positioned between the second ratchets and the holes of the shank to contact inward sides of corresponding second ratchets. A shaft is passed through the fixing element and the ratchet combinations, and is connected to the stopped disks plus the reel so that rotation thereof is passed onto the reel and the stopped disks.

A hoisting rope is connected to both the reel and the spreader supporting slide member, and passed over a pulley.

A handle is joined to the shaft for effecting rotation of the shaft. The handle is turned clockwise to wind the hoisting rope around the reel to spread the sunshade, the stopped disks making the second ratchets turn together with them. The handle is turned counterclockwise to unwind the hoisting rope to fold the sunshade, the stopped disks being turned relative to corresponding second ratchets. Friction of the second ratchets against the stopped disks counteracts the gravity on the spreader supporting slide member to prevent the sunshade from unwontedly folding from spread position once the sunshade is spread.

BRIEF DESCRIPTION OF THE DRAWINGS

The present invention will be better understood by reference to the accompanying drawings, wherein.

DETAILED DESCRIPTION OF THE PREFERRED EMBODIMENTS

Figure 1:
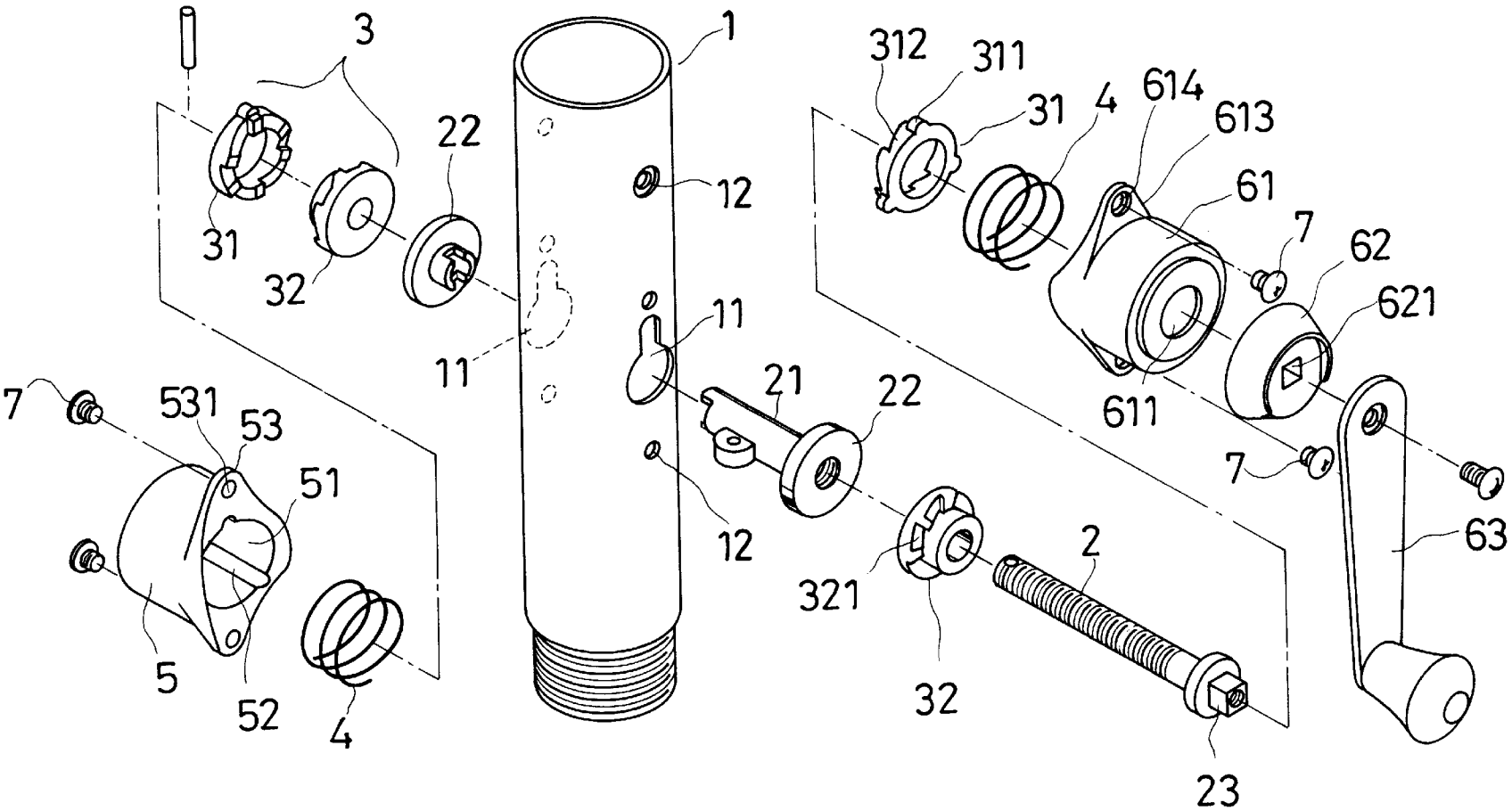
FIG. 1 is an exploded perspective view of the hoisting device for spreader supporting slide member of a sunshade according to the present invention.
Figure 2:
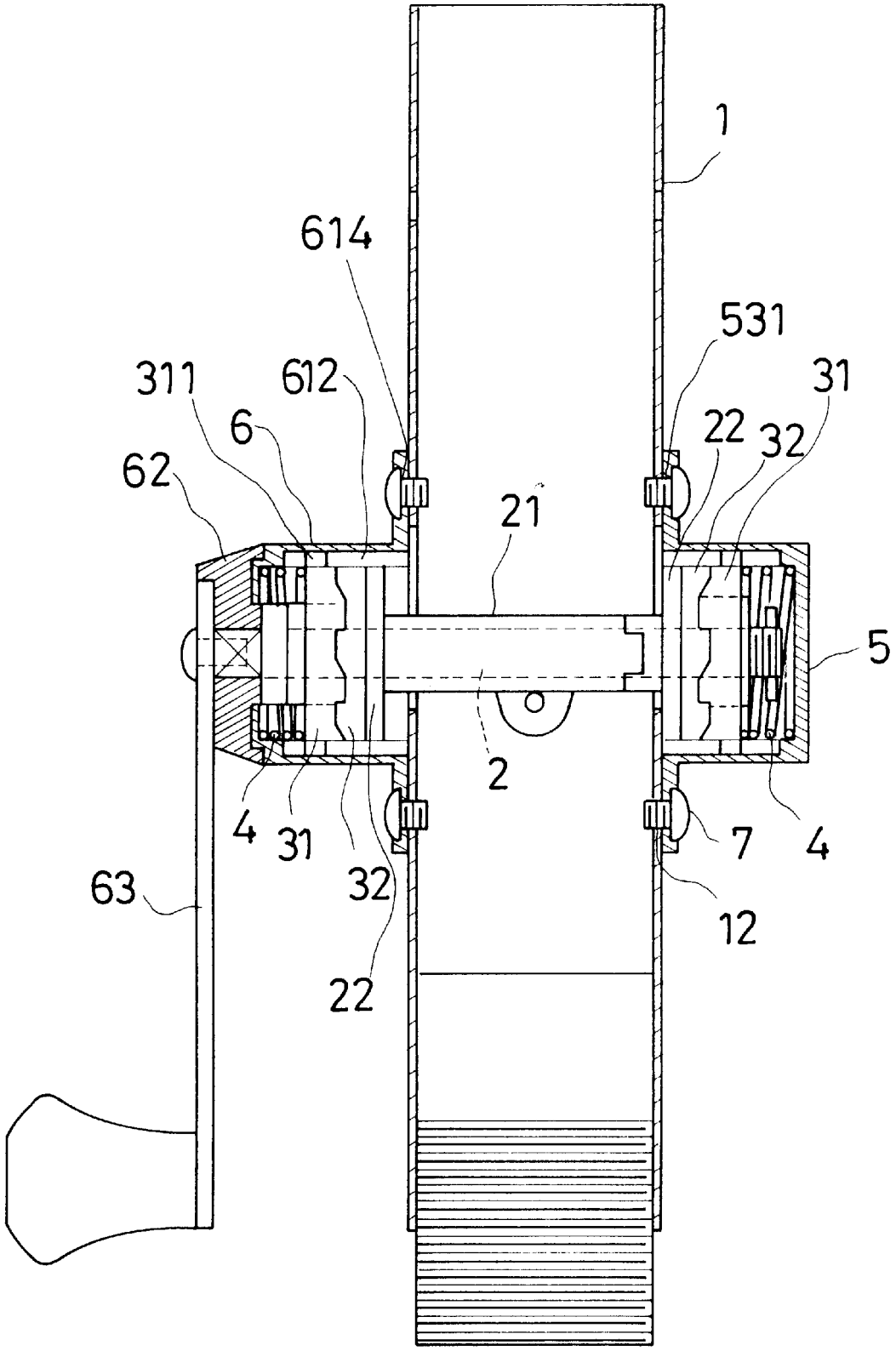
FIG. 2 is a cross-sectional view of the hoisting device for spreader supporting slide member of a sunshade according to the present invention.
Figure 3:
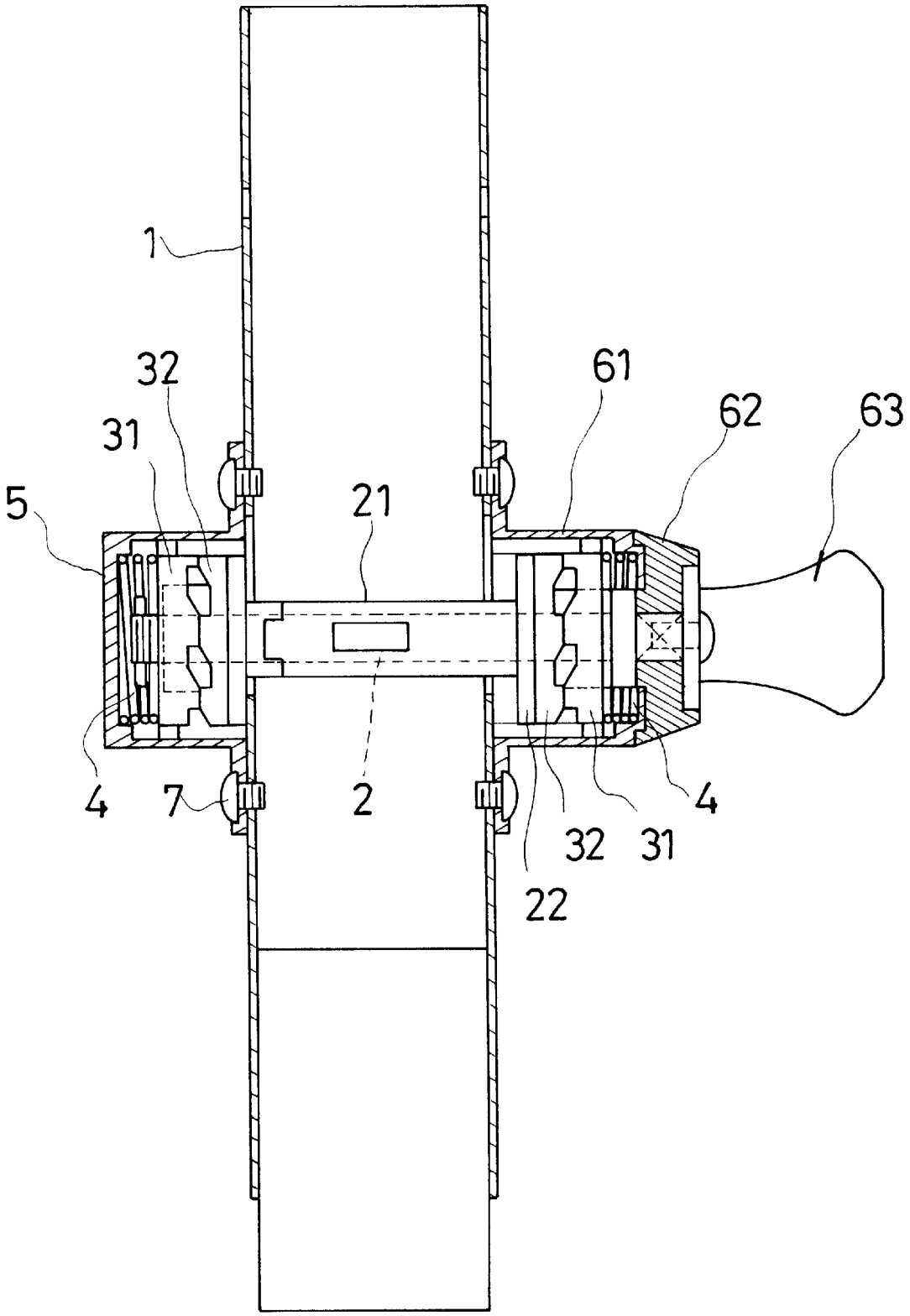
FIG. 3 is a view of the hoisting device of the present invention under operation.

Referring to FIGS. 1 and 2, a hoisting device for spreader supporting slide member of a sunshade according to the present invention includes a controlling member 6, a shaft 2, a reel 21, and first and second ratchet combinations 3, 3. Each of the ratchet combinations 3 includes a first ratchet 31, and a second ratchet 32. Each of the first ratchets 31 has spaced engaging protrusions 311 on an outer annular edge, and spaced ratchet teeth 312. Each of the second ratchets 32 has spaced engaging recesses 322 to contact the engaging protrusions 311 of corresponding first ratchet 31 such that it can turn relative to the first ratchet 31 clockwise only. A holding member 5 is provided, which has a holding room 51, connecting ears 53 having through holes 531, and several locating trenches 52 on an inner side thereof. The first ratchet combination 3 is housed in the holding room 51 of the holding member 5 with the second ratchet 32 being arranged next to an opening of the holding room 51. The engaging protrusions 311 of the ratchet 31 of the first ratchet combination are fitted onto the locating trenches 52 so that the ratchet 31 cannot turn.

A fixing element 61 is provided, which has a holding room 611, connecting ears 613 having through holes 614, and several locating trenches 612 on an inner side thereof The second ratchet combination 3 is housed in the holding room 611 of the fixing element 61 with the second ratchet 32 being arranged next to an opening of the holding room 611 .The engaging protrusions 311 of the ratchet 31 of the second ratchet combination are fitted onto the locating trenches 612 so that the ratchet 31 cannot turn.

The holding member 5, and the fixing element 61 are fixedly joined to opposing outer sides of a shank 1 of a sunshade so that the second ratchet 32 of both ratchet combinations are positioned between corresponding first ratchet 31 and the shank 1. The opposing outer sides of the shank 1 are formed with opposing through holes 11 to face corresponding second ratchets 32. The opposing outer sides of the shank 1 further have screw holes 12 so that screws can be screwed into the through holes 531, 614 of the connecting ears 53, 613 and the screw holes 12 to firmly join both the holding member 5 and the fixing element 61 to the shank 1.

In addition, springs 4, 4 are positioned next to the first ratchets 31 in the holding rooms 51, 611 so that both ratchet combinations are each biased towards the corresponding through holes 11 of the shank 1 with the springs 4, 4.

The reel 21 is passed through the through holes 11 of the shank 1. Two ends of the reel 21 are each joined to a stopped disk 22, which is positioned between a corresponding second ratchet 32 and one of the through holes 11 of the shank 1 to come into contact with an inward side of the corresponding second ratchet 32.

The shaft 2 is passed through the fixing element 611, and the ratchet combinations 3, 3 so that it can turn relative to the same. The shaft 2 is tightly passed through the reel 21, and the stopped disks 22 so that the same rotates together with the shaft 2; the shaft 2, and the reel 21 can be formed with threads on an outer side, and an inner side respectively so that the former can be screwed into the reel 21. The shaft 2 further has a polygonal joining end portion 23 sticking out from the fixing element 61.

Figure 4:
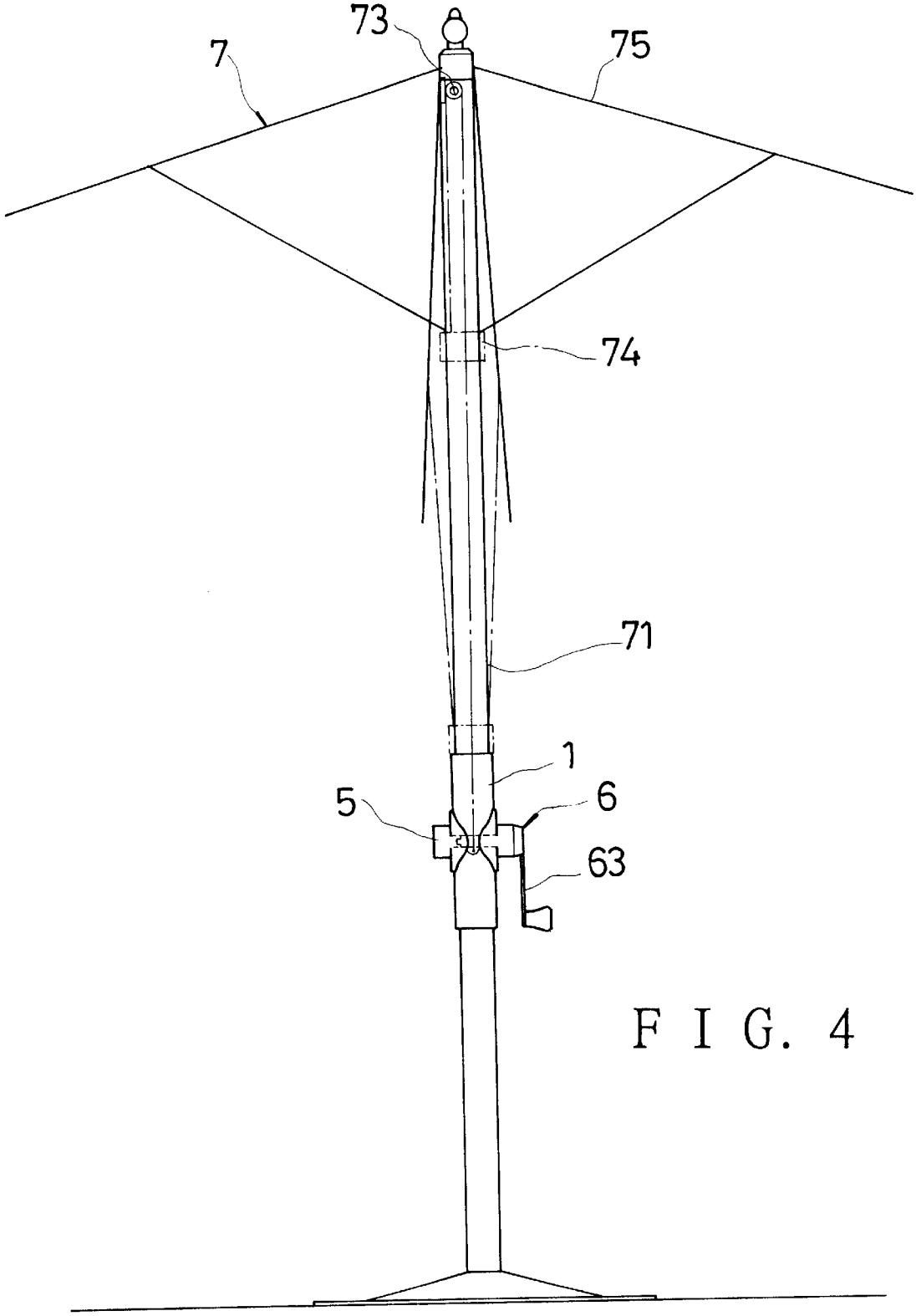
FIG. 4 is a view of a sunshade equipped with the hoisting device of the present invention.

Referring to FIG. 4, a hoisting rope 72 is connected to the reel 21 at one end, and a spreader supporting slide member 74 of the sunshade at other end. The spreader supporting slide member 74, to which spreaders pivoted to corresponding ribs 75 of the sunshade 1 are pivoted, can slide along an upper section of the shank 1. An intermediate portion of the rope 72 is passed over a pulley 73 disposed at upper end of the shank 71.

The controlling member 6 has a turning element 62, and a handle 63. The turning element 62 has a polygonal central hole 621, and is positioned next to the fixing element 61 to be joined to the joining end portion 23 of the shaft 2 at the central hole 621. The handle 63 is joined to the joining end portion 23 and the turning element 62 at one end thereof so that the shaft 2 can be turned by means of operating the handle 63.

To spread the sunshade, the handle 63 is turned clockwise to effect rotation of the reel 21 so that the hoisting rope 72 is wound around the reel 21 to lift the spreader supporting slide member 74 to an upper position, the stopped disks 22 causing the second ratchets 32 to turn together with them owing to friction of outward sides thereof against corresponding inward sides of the second ratchets 32.

To fold the sunshade, the handle 63 is turned counterclockwise to effect rotation of the reel 21 so that those portions of the hoisting rope 72 wound around the reel 21 separates from the reel 21, thus allowing the spreader supporting slide member 74 to move down due to gravity.

When the sunshade is completely spread or partly spread, friction of the inward sides of the second ratchets 32 against the stopped disks 22 will counteract the gravity on the supporting ring 74 to prevent the shaft 1 from turning counterclockwise, preventing the slide member 74 from being caused to fall down from lifted position by gravity therefore keeping the sunshade in position.

From the above description, it can be easily understood that the hoisting device of the present invention has an advantage that the second ratchets 32 are biased by the springs 4 to closely contact the stopped disks 22 so that the sunshade, once moved to completely spread or partly spread position, cannot unwontedly fold due to gravity on the spreader supporting slide member 74, allowing the users a lot of convenience.

What is claimed is:

1. A hoisting device for spreader supporting slide member of a sunshade, comprising first and second ratchet combinations; the first and second ratchet combinations each including a first ratchet, and a second ratchet engaged with the first ratchet to be capable of turning in a first direction; the ratchet combinations being each disposed near to a respective one of opposite first and second outer sides of a shank of a sunshade with the first ratchets being not capable of turning relative to the shank, and with the second ratchets being positioned between corresponding first ratchets and the shank;

the first and the second outer sides of the shank being formed with opposing through holes to face corresponding second ratchets; the ratchet combinations being each biased towards the corresponding through holes of the shank by means of a spring;

a reel passed through the through holes of the shank; two ends of the reel being each joined to a stopped disk positioned between the second ratchets and the through holes of the shank to come into contact with inward sides of corresponding second ratchets;

a shaft passed through the ratchet combinations; the shaft being screwed through the stopped disks plus the reel so that rotational movement thereof is passed onto the reel and the stopped disks; the shaft being capable of rotating relative to the ratchet combinations;

a hoisting rope connected to both the reel and a spreader supporting slide member of the sunshade;

a controlling member having a handle joined to an end of the shaft for effecting rotation of the shaft;

rotational movement of stopped disks in the first direction being effected by turning the handle so that the hoisting rope is wound around the reel to lift the spreader supporting slide member to spread the sunshade, causing the second ratchets to turn together with the stopped disks;

rotational movement of the stopped disks in a second direction opposite to the first direction being effected by turning the handle so that the hoisting rope is unwound from the reel to allow the slide member to move down due to gravity, making the sunshade fold;

friction of the inward sides of the second ratchets against the stopped disks counteracting the gravity on the slide member to prevent the shaft from turning in the second direction, keeping the slide member in lifted position without possibility of falling down due to gravity therefore keeping the sunshade in the spread position.

2. The hoisting device for spreader supporting slide member of a sunshade as claimed in claim 1, wherein locating members are provided to house the first and second ratchet combinations therein, and the first ratchets have engaging protrusions formed on an annular outer edge thereof; the locating members having locating trenches on inner sides thereof for allowing the engaging protrusions of the first ratchets to be fitted thereon for preventing the first ratchets from turning.

3. The hoisting device for spreader supporting slide member of a sunshade as claimed in claim 2, wherein both the locating members have connecting ears having through holes, and the shank is formed with screw holes in corresponding positions of the through holes of the connecting ears; screws being screwed into the through holes of the connecting ears and the screw holes of the shank to firmly join both the locating members to the shank.

* * * * *